US006905040B2

(12) United States Patent
Hilger et al.

(10) Patent No.: US 6,905,040 B2
(45) Date of Patent: Jun. 14, 2005

(54) FILLER DEVICE AND CLOSURE CAP HAVING COMPLEMENTARY ENGAGEMENT ELEMENTS

(75) Inventors: Reinhard Hilger, Kerpen (DE); Ralf Malskorn, Neuss (DE)

(73) Assignee: BLAU Kunststofftechnik Zweigniederlassung der Tesma Europa GmbH, Grevenbroich (DE)

( * ) Notice: Subject to any disclaimer, the term of this patent is extended or adjusted under 35 U.S.C. 154(b) by 344 days.

(21) Appl. No.: 09/832,910

(22) Filed: Apr. 12, 2001

(65) Prior Publication Data

US 2001/0035415 A1 Nov. 1, 2001

(51) Int. Cl.[7] ..... B65D 41/06

(52) U.S. Cl. ..... 220/301; 141/384; 220/86.2; 220/DIG. 33; 220/293

(58) Field of Search ..... 220/DIG. 33, DIG. 32, 220/290, 293, 296, 301, 302, 303, 86.1–86.3, 318, 323, 375, 300, 298; 215/330, 331, 208, 332; 141/384

(56) References Cited

U.S. PATENT DOCUMENTS

| | | | | | |
|---|---|---|---|---|---|
| 2,372,156 | A | * | 3/1945 | Buchman | 215/337 |
| 3,127,049 | A | * | 3/1964 | Welty et al. | 220/304 |
| 3,136,148 | A | * | 6/1964 | Nehls | 70/169 |
| 3,311,250 | A | * | 3/1967 | Lodding et al. | 215/340 |
| 3,682,345 | A | * | 8/1972 | Baugh | 215/330 |
| 4,160,511 | A | * | 7/1979 | Hukuta et al. | 220/210 |
| 4,298,129 | A | * | 11/1981 | Stull | 215/224 |
| 4,541,139 | A | * | 9/1985 | Jones et al. | 15/145 |
| 5,634,566 | A | * | 6/1997 | Jansen et al. | 220/254.8 |
| 5,641,012 | A | * | 6/1997 | Silversides | 141/384 |
| 5,901,869 | A | * | 5/1999 | Ohmura et al. | 220/210 |
| 5,924,590 | A | | 7/1999 | Jocic et al. | |
| 6,109,467 | A | * | 8/2000 | Schliemann et al. | 215/330 |
| 6,202,882 | B1 | * | 3/2001 | Hagano et al. | 220/86.2 |

FOREIGN PATENT DOCUMENTS

| | | | |
|---|---|---|---|
| EP | 0 683 108 | A2 | 11/1995 |
| EP | 1 004 468 | A2 | 5/2000 |
| EP | 1145890 | A2 * | 10/2001 |
| GB | 801228 | | 9/1958 |
| JP | 2001-355423 | * | 12/2001 |

* cited by examiner

*Primary Examiner*—Robin A. Hylton
(74) *Attorney, Agent, or Firm*—Liniak, Berenato & White, LLC

(57) ABSTRACT

A filler device has a filler neck (23) and a closure cap (1) which has an engagement segment (4). The engagement segment (4) and filler neck (23) have complementary engagement elements (7, 8, 25, 26), for example in order to form a threaded or bayonet connection. They can be brought, by movement of the closure cap (1) with respect to the filler neck (23), from an initial position without engagement via an engagement path subsequent thereto into a final position, and vice versa. A locking device (13, 14) which prevents the closure cap (1) from falling off by itself is arranged and configured so that it generates an elevated resistance to movement in a specific movement region of the closure cap (1). The locking device (13, 14) is arranged in such a way that it is effective at a distance from the final position.

17 Claims, 4 Drawing Sheets

FILLER DEVICE AND CLOSURE CAP HAVING COMPLEMENTARY ENGAGEMENT ELEMENTS

The invention concerns a filler device having a filler neck and a closure cap which has an engagement segment, the engagement segment and filler neck having complementary engagement elements, for example in order to form a threaded or bayonet connection, which can be brought, by movement of the closure cap with respect to the filler neck, from an initial position without engagement via an engagement path subsequent thereto into a final position, and vice versa; a locking device which prevents the closure cap from falling off by itself being arranged and configured in such a way that it generates an elevated resistance to movement in a specific movement region of the closure cap.

Filler devices of the kind described above are provided, for example, on internal combustion engines so they can be filled and refilled with oil. They have a filler neck that is shaped onto the engine block or the cylinder head cover of the internal combustion engine, and can be closed off with a matching closure cap. The closure cap has at the top a manipulation ridge with which it can be rotated. At the bottom, it projects with an engagement segment into the filler neck.

The engagement segment and filler neck have complementary engagement elements in order to form a threaded closure. In a known embodiment, the neck-mounted engagement elements comprise two oppositely located engagement projections, and the cap-mounted engagement elements comprise two thread-like engagement grooves which do not extend entirely over 180° in the circumferential direction. Placing the closure cap onto the filler neck in one of the two rotational position provided for it causes the engagement projections to end up in the initial position directly in front of the engagement grooves. Subsequent rotation of the closure cap causes the engagement projections to engage into the engagement groove, and to form a threaded connection once the final position is reached.

Since internal combustion engines generate vibrations and are exposed to shocks, the danger exists that the closure cap will loosen and fall off by itself. This involves a considerable danger to the engine, and is therefore undesirable. The existing art therefore provides for locking devices in the form of twist preventers, which increase the resistance to movement in a specific movement region to such an extent that it is impossible for the closure cap to come loose by itself. In the known embodiment, the locking device comprises locking lugs which project radially outward from the bottom of the engagement grooves and are elastically deflectable radially inward, and over which the engagement projections travel, briefly increasing the resistance to movement, as the closure cap is twisted on.

The locking lugs are arranged respectively in the region of the ends of the engagement grooves, so that the engagement elements reach their final position when they have just traveled over the locking lugs. The closure cap is thereby held in its final position, i.e. cannot move by itself. It has been found in practical use, however, that when the closure cap is operated, it is erroneously assumed that the final position has been reached when the resistance to movement increases because the locking lugs are being approached. The closure cap is then not rotated further, and from then on is unsecured. After a certain period of driving, it rotates by itself to the initial position and then falls off.

It is the object of the invention to configure a filler device in such a way as to ensure that the locking device(s) is/are in fact traveled over when the closure cap is closed.

According to the present invention, this object is achieved by the fact that the locking device is arranged in such a way that it is effective, i.e. is traveled over, at a distance from the final position. The basic idea of the invention is to arrange the locking device in such a way that it is already traveled over well before the final position is reached, preferably in the region of the initial position. When the resistance increases in this region, the user will not yet assume that he or she has reached the final position, and will continue to move the closure cap. This guarantees, with a high level of certainty, that the closure cap is prevented by the locking device(s) from coming loose by itself from the filler neck. It has not proven disadvantageous in this context that the closure cap can now move by itself a certain amount in the opening direction between the final position and the position in which the locking device becomes effective.

In a development of the invention, provision is made for the locking device to be arranged in such a way that it is effective in the first third of the engagement path toward the final position, preferably at the beginning of the engagement path, thus ensuring that the engagement elements are still in engagement if the closure cap has moved by itself in the direction of the locking device.

The possibility also exists, of course, of arranging the locking device in such a way that it is effective in the movement region before the engagement path, for example before the initial position is reached, but only if provision is made to ensure that the closure cap cannot fall off by itself. In a particularly preferred embodiment, the locking device is arranged in such a way that it is effective in the initial position, i.e. immediately in front of the engagement path, so that in the event it moves by itself in the opening direction, the closure cap is still held on before leaving the engagement path.

In a further embodiment of the invention, provision is made for the movement region to comprise an axial path for emplacement of the closure cap until the initial position is reached, and, subsequent thereto, a circumferential path until the final position is reached, the circumferential path comprising the engagement path. In this embodiment, the locking device should be effective in the region of the transition from axial path to circumferential path.

In a manner known per se, the locking device has a resiliently deflectable locking lug on one of the parts (filler neck or closure cap), which is located in the movement region of one engagement element against the other part, the locking lug preferably being arranged on the closure cap. Again in a manner known per se, the neck-mounted engagement element can have an engagement projection, and the cap-mounted engagement element can have an engagement groove. The cap-mounted engagement element can have an axial segment and a circumferential segment, the locking lug being arranged at the transition from the axial to the circumferential segment, and having inclined ramps in both the axial and the radial direction.

It is understood that the filler neck and the closure cap can also have several (preferably two) pairs of complementary engagement elements, which are arranged in such a way that the closure cap can be emplaced in a corresponding number of initial positions; and that an equal number of locking devices is then also provided, preferably such that each pair of complementary engagement elements has a locking device associated with it, so that the locking devices are traveled over simultaneously upon movement of the closure cap.

The invention is illustrated in more detail, with reference to an exemplary embodiment, in the drawings, in which.

Figure 1:
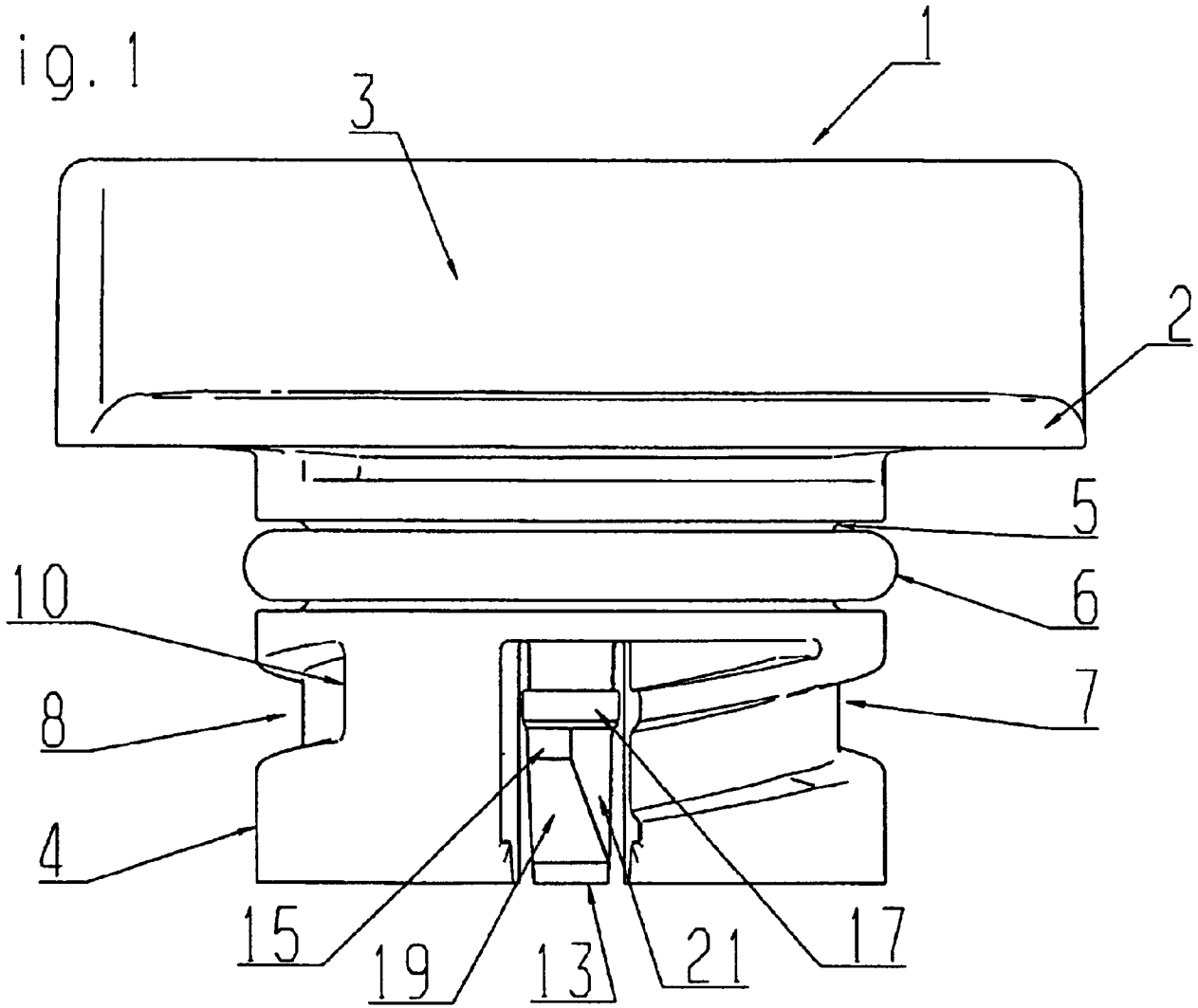
FIG. 1 shows a side view of the closure cap according to the present invention for a filler device.

Closure cap 1 depicted in the Figures has a horizontal cap plate 2 from whose upper side is elevated a manipulation ridge 3. Adjoining on the lower side is an engagement segment 4, of substantially cylindrical configuration, which is open toward the bottom.

Engagement segment 4 has, below cap plate 2, an annular groove 5 into which an O-ring 6 is set. Shaped into the outer side of engagement segment 4 below annular groove 5 are two engagement grooves 7, 8 that have an approximately rectangular cross section and begin diametrically opposite one another. From their starting points, they each coil upward approximately 120° and end in stops 9, 10.

The lower ends of engagement grooves 7, 8 terminate in axial grooves 11, 12 which open out at the lower end of engagement segment 4. Axial grooves 11, 12 are delimited radially inwardly by respective locking struts 13, 14, which are part of engagement segment 4 but are joined to it only at the top. They can thus resiliently deflect radially inward. Locking struts 13, 14 have locking lugs 15, 16 that project radially outward. In the undeflected state, they each protrude beyond the circumference of the bottom of the respective adjacent engagement groove 7, 8, but are recessed with respect to the outer circumference of engagement segment 4. Locking lugs 15, 16 are delimited at the top by stop ridges 17, 18, which lie approximately at the height of the upper-side boundaries of engagement grooves 7, 8. Associated with locking lugs 15, 16 are axial inclined ramps 19, 20, which run radially outward to locking lugs 15, 16. Facing toward engagement grooves 7, 8, locking struts 13, 14 have circumferential inclined ramps 21, 22 which begin at the outer edges of locking struts 13, 14 at the height of the respective adjacent bottoms of engagement grooves 7, 8 and extend radially obliquely outward to locking lugs 15, 16.

Figure 2:
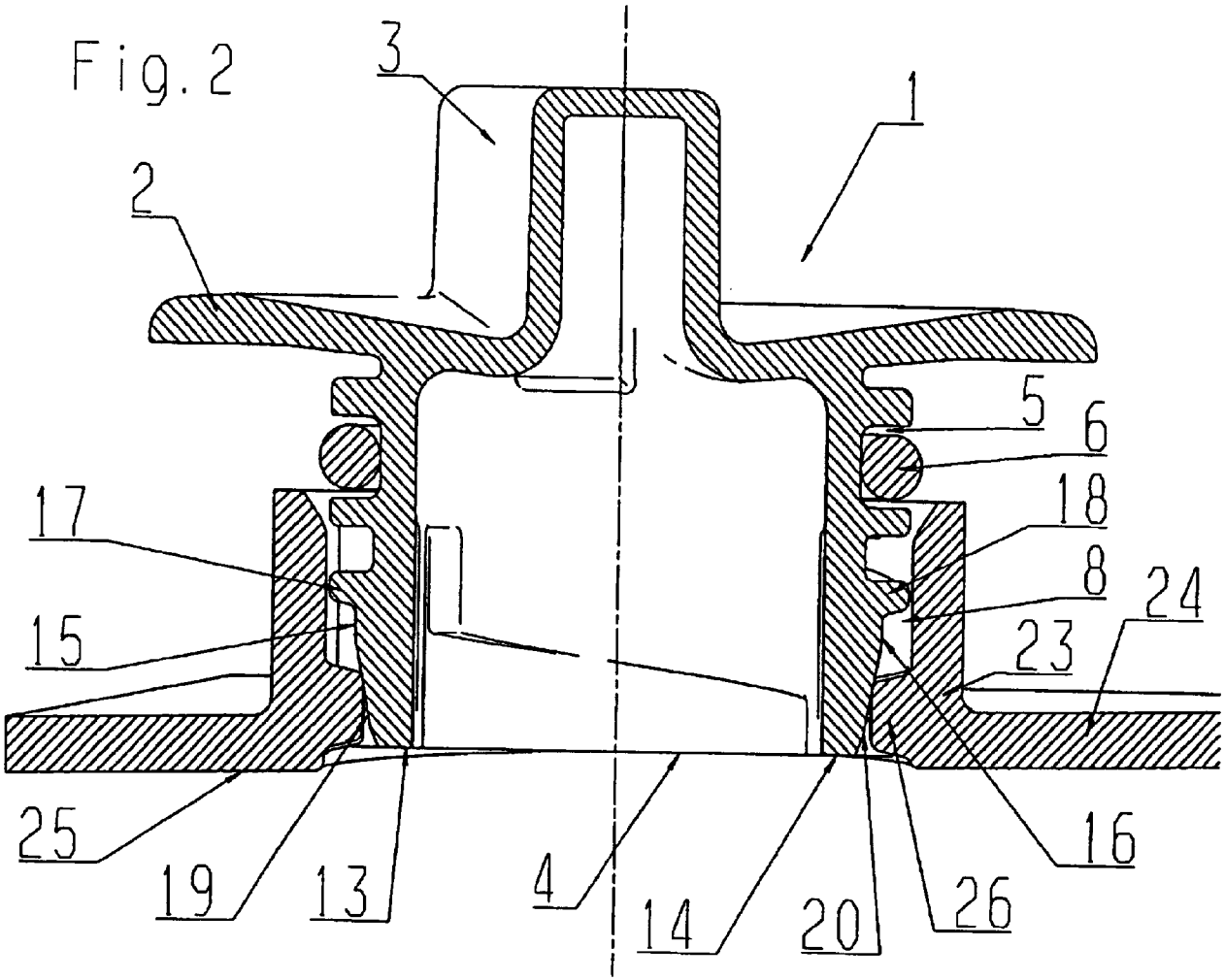
FIG. 2 shows a vertical section through the filler device according to the present invention, with the closure cap as shown in FIG. 1.

In FIG. 2, closure cap 1 depicted in FIG. 1 is inserted from above into a circular filler neck 23 in such a way that its engagement segment 4 protrudes into filler neck 23. Filler neck 23 is part of a cylinder head cover 24 (not depicted here in the further detail). Filler neck 23 is used for pouring in oil, which then flows through corresponding conduits into the oil sump of the internal combustion engine.

Figure 3:
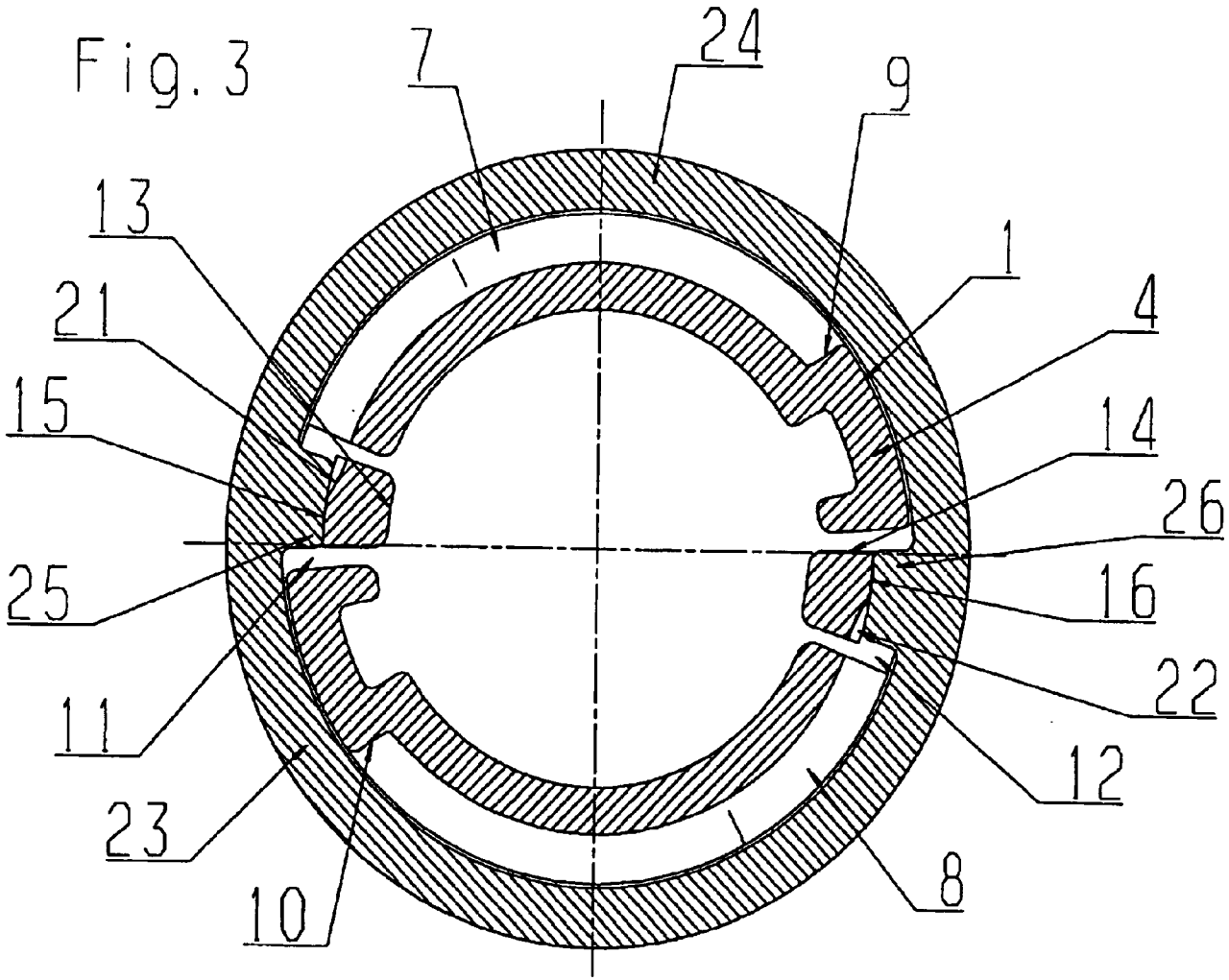
FIG. 3 shows a cross section through the filler device shown in FIG. 2, with the closure cap as seen from below in the initial position.

Filler neck 23 has two diametrically opposite and radially inwardly projecting engagement projections 25, 26, whose axial extension is dimensioned such that they can enter engagement grooves 7, 8. In FIG. 2, closure cap 1 is inserted axially in such a position and to such a distance that engagement projections 25, 26 fit into axial grooves 11, 12, and locking struts 13, 14 sit on the upper edges of engagement projections 25, 26, i.e. said upper edges are in contact with the lower regions of axial inclined ramps 19, 20. To ensure that engagement projections 25, 26 end up at the height of the respective entrance ends of engagement grooves 7, 8, closure 1 must be pushed axially downward until the upper sides of engagement projections 25, 26 come to rest against stop ridges 17, 18. In this context, axial inclined ramps 19, 20 cause locking struts 13, 14 to pivot radially inward, thus generating a certain resistance when closure cap 1 is moved axially. When engagement projections 24, 26 are in contact against stop ridges 17, 18, the initial position as defined above (in which engagement projections 25, 26 are located in front of the entrance ends of axial grooves 11, 12) has been reached. This situation is visible in FIG. 3.

Closure cap 1 can now be rotated in the direction of arrow A in such a way that engagement projections 25, 26 enter engagement grooves 7, 8. Closure cap 1 is thereby threaded into filler neck 23 until engagement projections 25, 26 come to rest against stops 9, 10 at the ends of engagement grooves 7, 8, and closure cap 1 has thus reached its final position.

Figure 4:
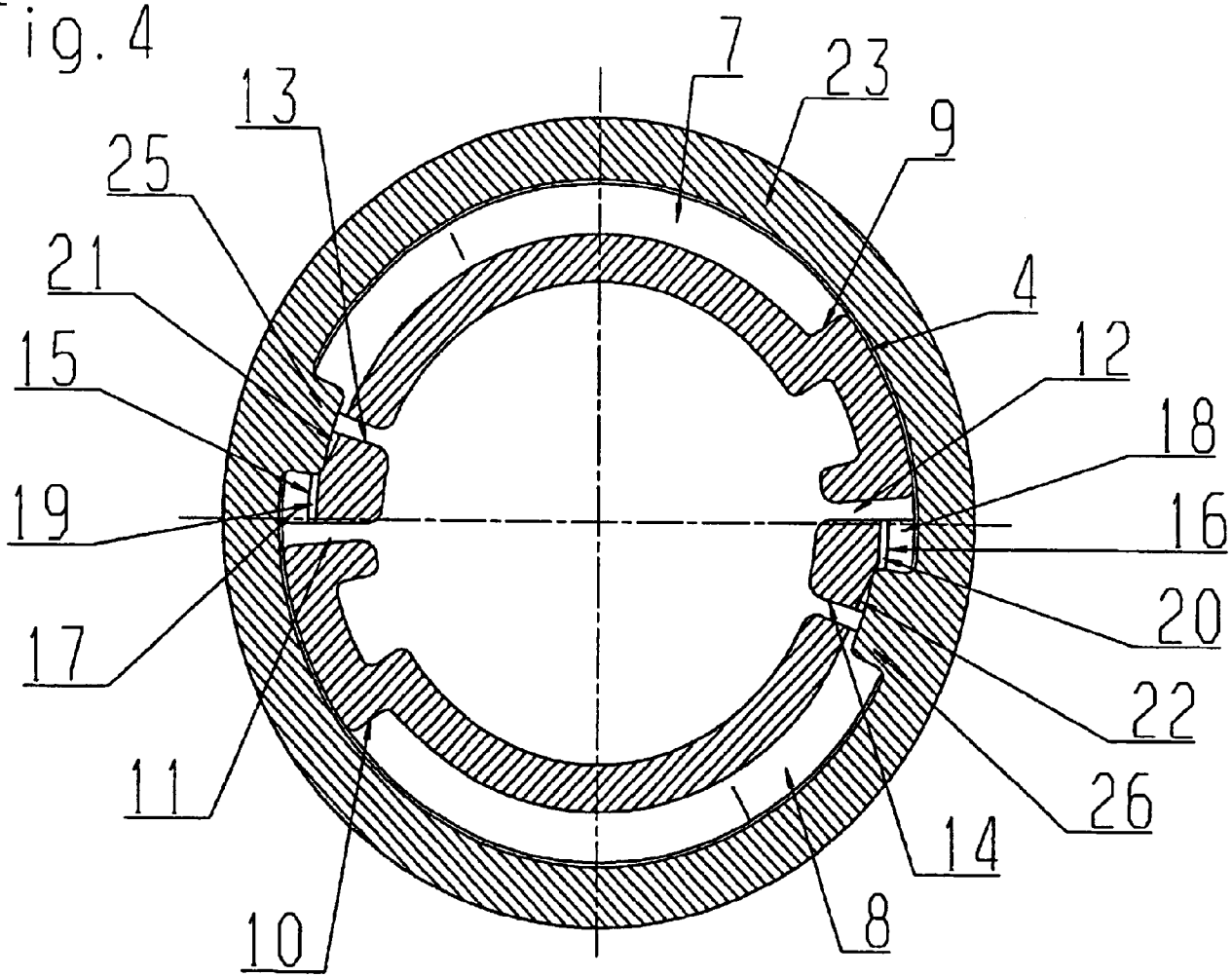
FIG. 4 shows a cross section through the filler device as shown in FIG. 3 during movement of the closure cap from the final position, upon reaching the locking devices.

If closure cap 1 rotates, as a result of vibration or other influences, toward its initial position, engagement projections 24, 25 at the end of engagement grooves 7, 8 strike against circumferential inclined ramps 21, 22, as is evident from FIG. 4. The latter act as stops, since despite their ramp-shaped configuration, the vibrations proceeding from the internal combustion engine are not capable of bending locking lugs 13, 14 radially inward. This ensures that closure cap 1 cannot fall off filler neck 23.

If closure cap 1 is to be removed from filler neck 23, it is rotated out of its particular position in the direction of arrow B in such a way that engagement projections 25, 26 arrive against circumferential inclined ramps 21, 22. An increase in the force being exerted causes engagement projections 25, 26 to travel up over circumferential inclined ramps 21, 22 as far as locking lugs 15, 16, thus deflecting locking struts 13, 14 radially inward. Closure cap 1 can then be pulled out axially upward.

Since locking struts 13, 14 with their locking lugs 15, 16 are arranged at the beginning of engagement grooves 7, 8, the increase in resistance to movement is produced at the transition from axial movement to circumferential movement and vice versa. This ensures that the operator in fact overcomes that resistance to movement, and does not perceive it as an end stop. Despite that, it is impossible for closure cap 1 to fall off by itself.

What is claimed is:

1. A filler device having a filler neck (23) and a closure cap (1), the closure cap (1) having an engagement segment (4), the engagement segment (4) and filler neck (23) each having complementary engagement elements (7, 8, 25, 26), which can be brought, by movement of the closure cap (1) with respect to the filler neck (23), from an initial position into a final position, a locking device (13, 14) operably associated with and preventing the closure cap (1) from falling off which generates a resistance to movement in a movement region of the closure cap (1), the movement region comprising an axial path for the closure cap (1) to the initial position, and from the initial position a circumferential path to the final position, characterized in that the locking device (13, 14) is effective at a region of transition from the axial path to the circumferential path, said locking device increasing the resistance to movement of the closure cap when said engagement elements are within said region of transition when bringing said closure cap with respect to said filler neck from either the initial position into the final position or the final position into the initial position.

2. The filler device as defined in claim 1, characterized in that the locking device (13, 14) is arranged in such a way that it is effective in the first third of the circumferential path toward the final position.

3. The filler device as defined in claim 2, characterized in that the locking device (13, 14) is arranged in such a way that it is effective at the beginning of the circumferential path toward the final position.

4. The filler device as defined in claim 1, characterized in that the locking device (13, 14) is arranged in such a way that it is effective in the movement region before the circumferential path.

5. The filler device as defined in claim 4, characterized in that the locking device (13, 14) is arranged in such a way that it is effective in the movement region before the initial position is reached.

6. The filler device as defined in claim 4, characterized in that the locking device (13, 14) is arranged in such a way that it is effective in the initial position.

7. The filler device as defined in claim 1, characterized in that the locking device (13, 14) has a resiliently deflectable locking lug (15, 16) on one of the filler neck (23) and the closure cap (1), which is located in the movement region.

8. The filler device as defined in claim 7, characterized in that the locking lug (15, 16) is arranged on the closure cap (1).

9. The filler device as defined in claim 8, characterized in that the filler neck has an engagement projection (25, 26), and the closure cap has an engagement groove (7, 8) for engaging said engagement projection.

10. The filler device as defined in claim 9, characterized in that the engagement groove (7, 8) has an axial segment and a circumferential segment.

11. The filler device as defined in claim 9, characterized in that the locking lug (13, 14) is arranged at the transition from the axial path to the circumferential path, and has inclined ramps (19, 20, 21, 22) in the axial and the radial direction.

12. The filler device as defined in claim 1, characterized in that the filler neck (23) and the closure cap (1) have several pairs of complementary engagement elements (7, 8, 25, 26), which are arranged in such a way that the closure cap (1) can be emplaced in a corresponding number of initial positions; and that an equal number of locking devices (13, 14) is provided.

13. A filler device, comprising:

a filler neck having an engagement projection;

a closure cap having an engagement groove for receiving said engagement projection, said engagement groove having an axial path and a circumferential path, and said closure cap having a locking strut, said locking strut having an axial ramp for generating resistance when said engagement projection is inserted into said axial path, and said locking strut having a circumferential ramp for generating resistance when said engagement projection is rotated circumferentially in said circumferential path, said locking strut being effective at a region of transition from said axial path to said circumferential path, said locking strut increasing resistance to movement of said closure cap when bringing said engagement projection within said region of transition either from the axial path or from the circumferential path.

14. The filler device of claim 13, wherein said filler neck and said closure cap have more than one engagement projection and engagement groove, respectively.

15. The filler device of claim 13, wherein said closure cap further comprises an annular groove having an O-ring, said annular groove adjacent said engagement groove.

16. The filler device of claim 13, wherein said locking strut is radially inwardly deformable.

17. The filler device of claim 13, wherein said locking strut further comprises a stop ridge at an end opposite said axial and circumferential ramps, said stop ridge defining an end point of said axial path for axially inserting said closure cap.

* * * * *